United States Patent [19]

Mengel

[11] Patent Number: 4,523,501

[45] Date of Patent: Jun. 18, 1985

[54] SLICER FEED MECHANISM

[75] Inventor: Ronald E. Mengel, Madison, Wis.

[73] Assignee: Oscar Mayer Foods Corporation, Madison, Wis.

[21] Appl. No.: 533,517

[22] Filed: Sep. 19, 1983

[51] Int. Cl.[3] ..... B26D 1/15

[52] U.S. Cl. ..... 83/42; 83/37; 83/73; 83/355; 83/420; 83/422

[58] Field of Search ..... 83/42, 37, 73, 76, 77, 83/420, 422, 355

[56] References Cited

U.S. PATENT DOCUMENTS

| | | | |
|---|---|---|---|
| 1,960,517 | 5/1934 | Taylor . | |
| 1,976,825 | 10/1934 | Ahrndt . | |
| 3,354,920 | 11/1967 | Hertwig . | |
| 3,880,035 | 4/1975 | Divan | 83/422 X |
| 4,015,494 | 4/1977 | Spooner et al. . | |
| 4,065,911 | 1/1978 | Fagan | 83/73 X |
| 4,151,772 | 5/1979 | Johnson . | |
| 4,163,406 | 8/1979 | Crawford . | |
| 4,226,147 | 10/1980 | Kumzi | 83/37 |
| 4,309,927 | 1/1982 | Dennis et al. . | |
| 4,329,900 | 5/1982 | Dennis et al. . | |

*Primary Examiner*—Donald R. Schran

*Attorney, Agent, or Firm*—Joseph T. Harcarik; Thomas R. Savoie; Daniel J. Donovan

[57] ABSTRACT

An apparatus and method are provided for feeding elongated product to a slicer in order to closely hold and control the product immediately before it engages the blade of the slicer and while pulling the product into the slicer blade. The apparatus includes a plurality of rotating augers that engage the product at a location immediately upstream of the slicer blade and that move the product into the blade. The apparatus and method accomplish precision slicing and the formation of uniform slices.

25 Claims, 2 Drawing Figures

SLICER FEED MECHANISM

Figure 1:
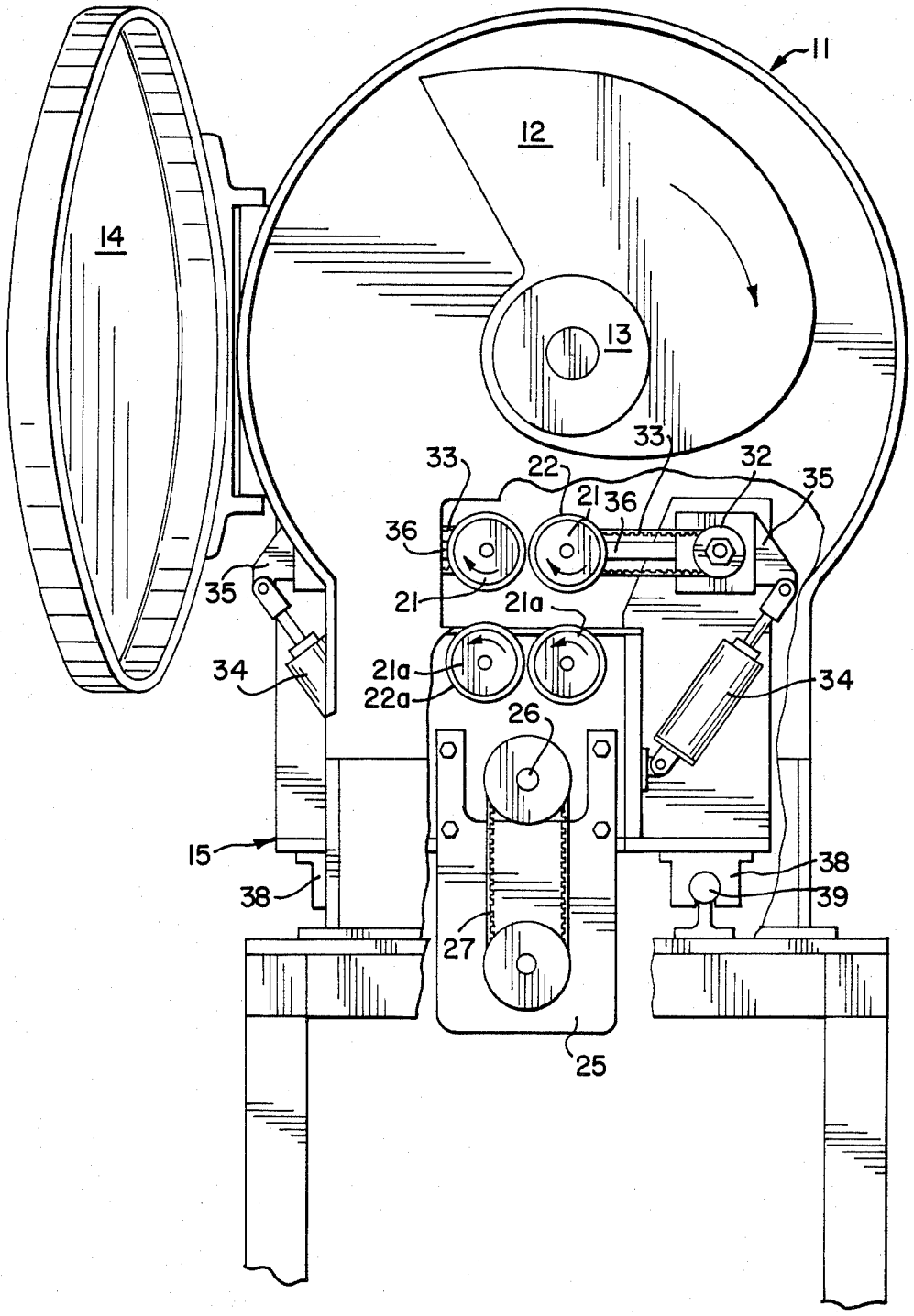

This invention generally relates to a mechanism for feeding product to a slicer, more particularly to an apparatus and method which accomplish precision control of the product immediately before it engages the blade of the slicer, which apparatus and method pull the product to the location at which it is sliced.

Automatic slicers of various types typically will include a feed mechanism for supporting and conveying product to be sliced to the slicing blade. Often such include a conveyor belt, ram, pusher arm, or combinations thereof that are provided in order to move the product to the slicing blade with enough force and control to permit the blade to slice through the product. Several types of products are sliced in this manner, including pork bellies, cheese, sausage, wood, plastic, primal meats and the like. Products of this type are generally quite dense and provide substantial resistance to the passage of the slicing blade therethrough, especially if they are resilient or exhibit a springiness that is characteristic of materials such as animal fat and the like. Such products can be difficult to control while being subjected to cutting forces of the type imparted by cutting blades. In addition, there is a tendency to form uneven slices, particularly at the end and at the beginning of the product, when the product is accelerating to the feeding speed or decelerating therefrom.

Particular problems arise when the product being sliced exhibits a great degree of compressibility or springiness, which would be evidenced by various food products, particularly pork bellies that are sliced during the processing of bacon products. These types of products tend to form slices having inconsistent thicknesses, particularly the first and the last to be included within a single package of bacon that consists of a series of slices that are spaced from a preceding and from a following series of slices. An especially difficult problem in this regard is the formation of thin slices at the beginning and at the end of each series of slices. Attempts to avoid the formation of such thin slices have in the past included attempts to move the product back away from the blade during those times in the slicing cycle when the product is likely to be moving at a speed slower than the speed needed to result in slices of a desired thickness. Such attempts are often unsuccessful because it is difficult to carry out a rapid reversal of the feed direction of feed mechanisms that rely upon pushing or pulling the tail end of the product.

The present invention achieves the type of feed control that improves the overall performance of a slicer mechanism insofar as control of the product and resultant slice uniformity are concerned. A plurality of augers are rotatably mounted along respective axes thereof that are generallly parallel to the feed path of the product, and each such auger is mounted in a manner whereby the leading edges thereof are generally parallel to and closely spaced from the slicing blade. The augers are positioned such that they engage the leading portion of the product whereby the product is pulled into the slicing blade.

It is accordingly a general object of this invention to provide an improved slicer feed mechanism.

Another object of the present invention is to provide an improved apparatus and method for achieving a uniform slicing of food products, particularly pork bellies, which are somewhat compressible and springy.

Another object of this invention is to provide an improved apparatus and method which rapidly pulls a product to a slicer blade, guides the product through the blade at a generally constant velocity, and rapidly pulls the unsliced, remaining product away from the slicing blade at the time that slicing is to be terminated in order to avoid the formation of undesirably thin slices.

Another object of the present invention is to provide an improved apparatus and method which grasps the leading longitudinal edges of the product at locations along the longitudinal perimeter thereof.

Figure 2:
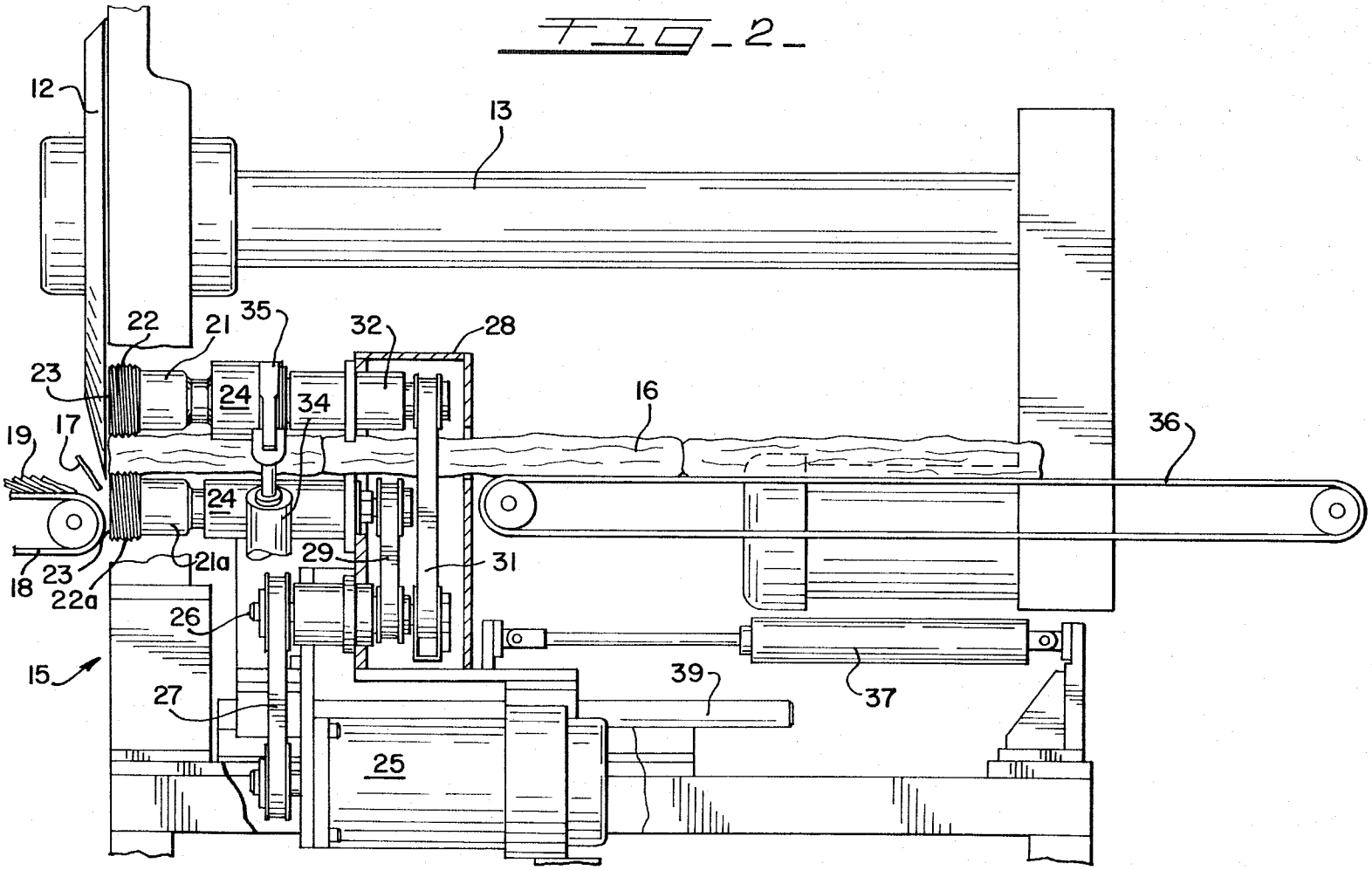

These and other objects of the present invention will become apparent from the following detailed description of this invention, taken in conjunction with the accompanying drawings wherein:

FIG. 1 is a front elevational view, partially broken away, of the feed mechanism of this invention as same is mounted in conjunction with a slicing apparatus; and FIG. 2 is a side elevational view of the apparatus illustrated in FIG. 1, showing a pork belly product being fed into and sliced by the blade.

A slicer of generally known construction is illustrated in FIG. 1, the overall slicer apparatus being generally designated as 11. The particular slicer 11 that is illustrated is of the rotary type wherein a rotating blade 12 is rotatably mounted along a shaft 13 that is generally parallel to the product path. Slicer 11 also includes a protective cover 14 and a product supporting and conveying assembly, generally designated at 15. Product 16, such as the pork bellies illustrated in FIG. 2, move along the supporting and conveying assembly 15 until such product 16 engages and is sliced by the blade 12 in order to form individual slices 17 which fall onto a collection conveyor 18 and form stacks 19 of product slices, which stacks 19 are spaced from each other along the collection conveyor 18 for subsequent processing into a packaged stack of slices generally corresponding in size to each stack 19.

As is customary with a slicer such as that illustrated, the thickness of each slice 17 will be a function of the speed at which the product 16 is fed to the blade 12, which blade 12 typically rotates at a constant speed. When the product supporting and conveying assembly 15 moves the product into the blade 12 at a relatively fast speed, then the thickness of each slice 17 is relatively thick since the product 16 moves across the plane of the blade 12 for an extended length as compared with the length of movement through the plane of the blade 12 when the product 16 is moving at a slower speed which would form thinner slices. With more particular reference to the product supporting and conveying assembly 15, such is a controlled feed assembly that includes a plurality of augers 21 having a helical surface 22 which engages the product 16 and moves the same toward the blade 12 when the augers 21 rotate in predetermined forward or feed directions, such as the directions illustrated in FIG. 1. Augers 21 are positioned such that they engage the leading portion of the longitudinal surface of the product 16. Preferably, a plurality of augers 21 are spaced along the perimeter of the product 16 at this leading portion of the elongated surface. It is especially important to note that the leading edge of the helical surface 22 is closely spaced from the rotating blade 12, while the leading edge 23 of the auger 21 is generally parallel to the plane of the blade 12. Helical surface 22 preferably has a total longitudinal length that is less than that of the product supporting and conveying assembly 15, and most preferably less than the longitudinal length of the auger 21 such that the helical surface 22 engages only the leading portion of the product 16 in order to most effectively pull the product 16 into the blade 12.

Referring more particularly to the spacing of the augers 21 generally along the perimeter of the product 16, the preferred arrangement includes at least one top auger 21 and at least one bottom auger 21*a*, each having respective helical surfaces 22, 23 which rotate in opposite directions. The illustrated product supporting and conveying assembly 15 includes two top augers 21 and two bottom augers 21*a* which are spaced from each other along the width of the product 16. Any of the various augers 21, 21*a* may be fixed, floating or spring loaded, and such could also be located along the sides of the perimeter of the product 16.

Preferably, each auger 21, 21*a* is cantilevered such that each is rotatably mounted along a mounting shaft 24 that projects from only one longitudinal end of the auger 21, 21*a*, which is the longitudinal end at its end opposite from the leading edge 23. This cantilevered mounting facilitates the close association between each leading edge 23 and the blade 12.

Each rotating shaft 24 of the augers 21, 22*a* is rotated at the same predetermined absolute speed by means of a motor 25 which is preferably a DC servomotor, typically having an integral tachometer and encoder, most advantageously being microprocessor controlled. Suitable drive mechanisms are provided including the illustrated main drive shaft 26, which is driven by the motor 25 through a timing belt 27. The drive shaft 26 extends into a drive box 28 which contains a mechanism for rotating the cantilevered mounting shafts 24. With respect to the cantilevered mounting shafts 24 for the bottom augers 21*a*, each is driven by an appropriate drive member such as bottom auger timing belt 29 which is driven by the main drive shaft 26. Such main drive shaft 26 also drives an upper auger timing belt 31, which in turn drives a rotating pivot shaft 32 which in turn drives the upper auger 21 through a timing belt 33.

Preferably, as illustrated, each of the upper augers 21 and its associated rotating pivot shaft 32 are mounted in a manner that permits the augers 21 to be pivoted generally upwardly or downwardly in order to provide a variable clearance between the upper augers 21 and the lower augers 21*a* to thereby accommodate products 16 of varying heights and in order to facilitate cleaning of the auger assembly. Such a structure, in addition, permits the top augers 21 to impart the desired amount of pressure onto the product 16.

The illustrated structure in this regard includes a pivot assembly having a pneumatic cylinder 34 that is in operative inter-engagement with a pivot arm 35 which is mounted onto the rotating pivot shaft 32. Each top auger 21 is mounted onto an extending portion 36 of the pivot arm 35 that is at the end of the pivot arm 35 which is generally opposite to its operative inter-engagement with the pneumatic cylinder 34. In the arrangement shown in the drawings, each extending portion 36 and its top auger 21 will move generally downwardly onto the product 16 when the pneumatic cylinder 34 is extended, and auger 21 will move generally upwardly when the pneumatic cylinder 34 is retracted.

While the auger assembly can provide the supporting and conveying functions needed to feed product 16 to the blade 12, it is often convenient to combine same with supplemental conveying and supporting arrangements such as the illustrated belt conveyor 36, other types of conveying means such as pin conveyors, metal slotted conveyors, sprockets, rollers or the like. If desired, in order to facilitate clean up of the apparatus, the entire auger assembly can be moved horizontally toward and away from the slicer blade 12 by means of a large pneumatic cylinder 37, movement of the auger assembly being along linear ball bushings 38 which run on stationary guide rods 39.

Mounting of the augers 21, 21*a* onto their respective cantilevered shafts preferably includes variable spacers such as washers so that the augers 21, 21*a* are readily and precisely adjustable therealong to insure that the leading edges 23 lie in substantially the same plane, which plane may be spaced only a few thousandths of an inch from the inside plane of the blade 12, and such leading edges 23 remain within this plane throughout the feeding procedure. Product 16 is continuously fed to and by the auger assembly, there being no need to horizontally retract or advance the augers 21, 21*a* along their respective shafts when another piece of product 16 is inserted into the system.

With more particular reference to the helical surfaces 22, 22*a* of the augers 21, 21*a*, each includes "flights" that are thin and sharp such that they cut into the product 16 and provide the desired forward push. All of the augers 21, 21*a* rotate synchronously and at the same speed, and all of the helical surfaces 22, 22*a* have the same pitch diameter and pitch length. Each of the particular helical surfaces 22, 22*a* have a screw pitch, depth of screw flight, profile, and rotational speed that is designed as necessary in order to provide accurate movement of the product 16 into or away from the blade 12. The needed pitch of the helical surfaces 22, 22*a* is determined by the speed of the slicer blade, by the slice thickness desired, and by the rotational speed of the augers 21, 21*a*. The auger pitch is proportional to the rotational speed of the slicer blade and to the desired slice thickness, and it is a function of the speed of the augers 21, 21*a*.

Regarding formation of the spaced stacks 19 of product slices 17, such is usually carried out without varying the rotational speed of the blade 12. Instead, this spacing, which may be considered as a pause in the slicing operation, is carried out by adjusting the speed and direction of the controlled feed of product 16 to the rotating blade 12. Such is accomplished by simultaneously varying the velocity and rotational direction of the augers 21, 21*a*.

During the time that the product is being sliced, the augers 21, 21*a* move at a uniform forward speed until such time as enough product slices 17 have formed a stack 19 of the desired size. At that time, the auger rotational direction is rapidly reversed to an absolute speed that is greater than the oppositely directed feeding speed, which achieves a rapid reversal of the feed direction of the product 16 such that the product 16 is withdrawn from the slicer blade 12 before an undesirably thin slice is cut. After a time of very short reverse rotation, such reverse rotational speed is rapidly reduced to zero to provide a dwell period which results in spacing between the stacks 19. When the desired spacing between the stacks 19 is attained, the augers 21, 21*a* accelerate in the forward or feed direction to a speed greater than the feeding speed, which greater forward speed is maintained for a short period of time in order to avoid the formation of a thin first slice, after which the auger speed is rapidly decelerated back to the desired constant feeding velocity until such time as the desired stack size is formed.

This invention can be embodied in various forms and, therefore, it is to be construed and limited only by the scope of the appended claims.

I claim:

1. An apparatus for feeding product to a slicer assembly having a blade for slicing an elongated product that is fed to the blade by a product supporting and conveying assembly, wherein the product supporting and conveying assembly includes a supplemental product supporting assembly and a controlled feed assembly downstream of and generally coextensive with the product supporting assembly, said controlled feed assembly comprising:

a plurality of augers, said augers being rotatably mounted along respective axes that are generally parallel to the feed path of said product supporting and conveying assembly;

a leading edge on each of said augers, said auger leading edges being closely spaced from the blade of the slicer;

said augers are sized and positioned for engaging the product along a leading length of longitudinal surface, said leading length of longitudinal surface of the product being along that portion of the product which is closest to the slicing blade, and said auger leading edges define a leading end of the product leading portion, whereby rotation of said augers in a respective feed direction of each auger pulls said product into slicing engagement with said blade; and said controlled feed assembly includes means for controlling the rotational movement, rotational speed and direction of rotation of said augers to thereby control longitudinal movement of the leading length of the product and the speed and direction of product feed relative to said blade.

2. The apparatus of claim 1, wherein said controlling means includes a dwell mode during which said product is out of slicing engagement with said blade to provide a desired amount of spacing between groups of product slices.

3. The apparatus of claim 1, wherein each of said augers has a helical surface having a leading end that is defined by said leading edge of the auger.

4. The apparatus of claim 1, wherein said leading edge of each auger is generally parallel to the blade.

5. The apparatus of claim 1, wherein said augers of the controlled feed assembly are positioned to engage the top surface and the bottom surface of the product.

6. The apparatus of claim 1, further including cantilevered means for rotatably mounting said augers.

7. The apparatus of claim 1, wherein said blade is a rotary blade.

8. The apparatus of claim 1, wherein said sizing and positioning of said augers are for engaging a pork belly product.

9. The apparatus of claim 1, wherein said means for controlling the augers rotates each said augers at the same absolute rate.

10. The apparatus of claim 1, wherein at least one of said augers is pivotally mounted to thereby allow for varying spacing between such auger and another of the augers.

11. The apparatus of claim 1, wherein said close spacing between said auger leading edges and said blade is a few thousandths of an inch.

12. The apparatus of claim 1, wherein each of said augers has a helical surface that has thin and sharp flights that cut into the product.

13. The apparatus of claim 1, wherein the augers rotate synchronously with each other.

14. The apparatus of claim 1, wherein said controlling means includes: a feed mode during which said augers rotate at a substantially constant forward feed velocity, and a rapid deceleration and reverse acceleration mode during which said auger rapidly decelerate and then rapidly accelerate in a direction opposite to that of said feed mode, said rapid acceleration being to an absolute speed greater than the absolute value of said forward feed velocity.

15. The apparatus of claim 1, wherein said controlling means includes: a feed mode during which said augers rotate at a substantially constant forward feed velocity, a rapid deceleration and reverse acceleration mode during which said product is rapidly moved out of slicing engagement with said blade, a dwell mode during which said product is not fed to said blade, and a rapid forward acceleration mode during which the rotational speed of said augers accelerates to a speed that is at least as fast as said feed mode speed.

16. The apparatus of claim 15, wherein the rapid forward acceleration mode of said controlling means rotates said augers to an absolute speed that is greater than said feed mode speed.

17. The apparatus of claim 1, wherein said controlling means includes a feed mode during which the rotational speed of the augers is variable in order to adjust product slice thickness.

18. A method for feeding product to a slicer assembly having a blade for slicing an elongated product that is fed to the slicing blade, wherein the method comprises:

positioning a plurality of augers generally parallel to the product feed path and such as to have the respective leading edges of the augers closely spaced from the slicing blade;

gripping and feeding a leading portion of the product to be sliced, said gripping and feeding step including rotatably engaging the product with a plurality of rotating augers and feeding the product into the slicing blade by rotating the augers in a respective feed direction of each auger to pull the leading edge of the product into the slicing blade; and controlling the rotational movement, rotational speed and direction of rotation of the augers to thereby control longitudinal movement of the product and the speed and direction of product feed relative to the blade.

19. The method of claim 18, wherein said controlling step includes rotating the augers synchronously with respect to each other.

20. The method of claim 18, wherein the method slices pork bellies.

21. The method of claim 18, wherein said controlling of the augers includes:

a feeding step during which the augers rotate at a substantially constant forward feed velocity;

a rapid deceleration and reverse acceleration step during which the product is rapidly moved out of engagement with the blade; and a dwell step during which said feeding step is suspended.

22. The method of claim 18, wherein said controlling of the augers includes:

a feeding step during which the augers rotate at a substantially constant forward feed velocity; and a rapid deceleration and reverse acceleration step during which the augers rapidly decelerate and then rapidly accelerate in a rotary direction opposite to that of the feeding step, said rapid reverse acceleration being to an absolute speed greater than the feeding step absolute speed.

23. The method of claim 18, wherein said controlling of the augers includes:

a feeding step during which the augers rotate at a substantially constant forward feed velocity;

a rapid deceleration and reverse acceleration step during which the product is rapidly moved out of engagement with the blade;

a dwell step during which said feeding step is suspended; and a rapid forward acceleration step during which the augers are accelerated in the forward feed direction and to a rotational speed that is at least substantially equal to the forward feed velocity.

24. The method of claim 18, wherein said controlling of the augers includes:

a feeding step during which the augers rotate at a substantially constant forward feed velocity;

a rapid deceleration and reverse acceleration step during which the product is rapidly moved out of engagement with the blade;

a dwell step during which said feeding step is suspended; and a rapid forward acceleration step during which the augers are accelerated in the forward feed direction and to a rotational speed that is greater than the forward feed velocity.

25. The method of claim 18, wherein said controlling of the augers includes a feeding step during which the rotational speed of the augers is variable in order to adjust product slice thickness.

* * * * *